US005375943A

United States Patent [19]

McCavour et al.

[11] Patent Number: 5,375,943

[45] Date of Patent: Dec. 27, 1994

[54] SHORT RADIUS CULVERT SECTIONS

[75] Inventors: Thomas C. McCavour, Etobicoke; Jean-Louis Major, Cambridge, both of Canada

[73] Assignee: Michael W. Wilson, New Brunswick, Canada

[21] Appl. No.: 137,833

[22] Filed: Oct. 15, 1993

[51] Int. Cl.[5] ..... F16L 9/00

[52] U.S. Cl. ..... 405/126; 52/80.1; 138/173; 138/177; 405/124

[58] Field of Search ..... 405/124, 125, 126; 52/80.1, 80.2, 86; 138/173, 177

[56] References Cited

U.S. PATENT DOCUMENTS

| | | | |
|---|---|---|---|
| 1,203,656 | 11/1916 | Shannon | 405/126 X |
| 3,638,434 | 2/1972 | Delacre | 138/173 X |
| 4,141,666 | 2/1979 | DeGraff | 405/126 |
| 4,700,514 | 10/1987 | Reineman | 52/80.1 X |
| 4,958,476 | 9/1990 | Kotter | 52/80.1 X |
| 5,065,554 | 11/1991 | Neya et al. | 52/80.1 X |

FOREIGN PATENT DOCUMENTS

| | | | |
|---|---|---|---|
| 862402 | 2/1971 | Canada | 405/126 |

*Primary Examiner*—Dennis L. Taylor
*Attorney, Agent, or Firm*—Lee, Mann, Smith, McWilliams, Sweeney & Ohlson

[57] ABSTRACT

Soil/metal supporting structures commonly include panel sections having a short radius of curvature in the range of 750 mm to 2,500 mm. In such soil metal supporting structures the panels are of heavy gauge in the range of 2 mm to 10 mm thickness. Usually, expensive tooling and forming techniques are required to cold form the heavy gauge material into a curved shaped having such short radius. Such expensive techniques have been eliminated by this invention by virtue of the improvements comprising:

a) the panels have a high degree of ductility before being cold formed, such high degree of ductility being determined by a ratio of specified minimum yield strength to specified minimum tensile strength equal to or less than 0.8;

b) the panels are cold formed with cross-corrugations in each of the inside ridges of the longitudinally formed corrugations of the panel, the cross-corrugations are sinusoidal and cross section and allow the cold forming of a short radius panel on a consistent basis without distorting panel shape to facilitate thereby interconnection of the panels for the structure;

c) the cross-corrugations have a depth in the range of 4 mm to 12 mm and a pitch of 40 mm to 70 mm; and d) the cold formed panels of short radius by virtue of the sinusoidal shaped cross-corrugations provide a finished panel with marginal increase in ductility, thereby allowing for either plastic or elastic analysis in providing the soil/metal supporting structure.

27 Claims, 4 Drawing Sheets

SHORT RADIUS CULVERT SECTIONS

FIELD OF THE INVENTION

This invention relates to soil/metal supporting structures as found in the form of culvert structures. Such structures include short radius panel sections which can now be formed in accordance with this invention in an economically consistent non-distorted shape.

BACKGROUND OF THE INVENTION

Soil/metal supporting structures are most commonly in the form of culverts which are either circumferentially continuous or have an open bottom commonly referred to as either a box culvert or a re-entrant arch shaped culvert. These culverts are used to direct water ways and for use as bridges in roadways, railways and the like. The design of the soil/metal supporting culvert is to accommodate designed soil loads and as well anticipated rolling loads and static loads which might be applied to the roadway, railway and the like. Usually such structures are formed from steel or aluminum. As is usually the case the plates used in forming the support structure are corrugated in the direction of their longitudinal length. The extent of corrugation depends upon the thickness and radius of curvature in the panel.

Culverts in the form of elliptical, round, pear, arch or pipe-arch shapes or the box culvert shape include portions across their section which are curved and have a relatively short radius of curvature. Such short radius of curvature is usually in the range of 750 mm to 2,500 mm in the longitudinal direction of the panel. For example, such short radius regions in the box culvert structure is described in respect of applicant's co-pending U.S. patent application Ser. No. 08/026,860 filed Mar. 5, 1993. That application in particular relates a form of continuous reinforcement in an uninterrupted manner to provide an optimum load carrying capacity for a selected extent of reinforcement. Although the short radius of curvature panels for this box culvert can be formed using existing types of roll forming and bending presses, the equipment is expensive and complex to use in order to achieve the manufacture of short radius panels having consistent dimensional configurations so that the panels can be readily attached to one another by way of appropriate alignment with one another so that bolts may be used to fasten the panels together through the aligned bolt holes. The same approach applies with respect to other culvert styles involving short radius of curvature sections. It is generally understood that even with the rather expensive approach to cold forming such radius of curvature panels, some distortion can occur due to the short radius which can hamper erection of the structure and hence, delay field insulation.

Another problem to be considered in the cold forming of these thick gauge panels to the short radius specifications is that cold working normally decreases ductility of the panels. Such decrease in ductility can be such that the structure can no longer be designed on the basis of plastic analysis and instead must be designed on the basis of elastic analysis which requires the use of even thicker gauge materials with considerably more reinforcing. It therefore becomes very important that in such cold working of the panels to provide the specified short radius, the bending be carried out in a manner which does not reduce the ductility, induce case hardening in the outside of the structure and also avoids the possibility of forming micro-cracks in the outside portions of the structure. Such problems are addressed in U.S. Pat. No. 5,118,218. It is suggested that when forming short radius of curvature panel sections, that such forming be done while the panels are hot to avoid any case hardening problems. It is also suggested that aluminum sheet material be used in place of steel since it is more easily bent. However, as described, aluminum has less ductility than steel when it comes to plastic design analysis for the soil/metal structure. There continues to be a problem in respect of cold forming short radius of curvature panel sections particularly with deep corrugations in the range of 50 to 200 mm.

Other than the suggested hot forming of the short radius of curvature for the deep corrugation panels, there does not appear to be much other guidance in the prior art in respect of how such deep corrugation panels of thick gauge may be bent to short radius specifications without inducing case hardening, embrittlement and micro-cracks.

There are a number of examples in the bending of light gauge deep corrugated panels for use in arch shaped building structures. These structures are designed to carry a snow load but not a soil load such as required in bridges or the like so that the light gauge material is quite acceptable. These arch type buildings more commonly referred to as quonset huts are constructed with cold formed panels using either trapezoidal or sinusoidal corrugation profiles with depths up to 200 mm and radius of curvature from 3000 to 12,000 mm. The light guage material used in forming these panels is in the range of 0.75 mm to 1.5 mm. With such thin gauged materials and large radius of curvature there is very little working of the metal in cold forming panels for use in such structures to the desired radius of curvature. However, to facilitate such bending, it is well known that some form of cross-deformation is employed on the inside ridge of these panels to facilitate bending. Such cross-deformation may be in the form of metal tucks, diamond shaped indents and sinusoidal shaped indents and the like. Such corrugations which in essence extend transversely of the longitudinal direction of panel facilitate bending of the light gauge material to the specified radius of curvature. By virtue of the thin gauge material, it is generally thought that there is very little if any cold working of the material so that there is very little if any loss in ductility. Loss in ductility however is not of great concern in the design of arch shaped buildings because they are designed on an elastic basis taking into consideration snow loads and wind resistance. Furthermore, with this type of arch building the depth of the cross corrugations in the curved panel is usually from only 1.5 to 3 mm with a pitch of 25 to 50 mm which again contributes to the general understanding that there is little if any cold working of the material in forming the desired radius of curvature in the panel. In any event, the use of cross corrugations in this light gauge material for arch structures does assist in the cold forming of the structure by avoiding stretching of the outside surface and by virtue of the cross corrugation, shortening the inside arc length of the panel to achieve the desired radius. Furthermore, such corrugations can be of a variety of shapes which are in line, discontinuous or misaligned where there depth usually reduces to zero as the cross corrugation approaches the apex of the outside ridge of the corrugated panel.

There have of course been various attempts to improve on the overall structural benefits in the panel designs for arch buildings and their types of interconnections. For example, as disclosed in U.S. Pat. No. 3,959,942, a specifically designed spacer and transverse reinforcing beam is provided for interconnecting of panels preferably along a single axis for the entire length of the structure. Such interconnection may be acceptable for light gauge materials where the only consideration is snow loading. U.S. Pat. No. 3,968,603 also discusses the use of cross-corrugations in the base of the trough section of the longitudinally extended corrugated panels. It is recognized however that there is a problem in bending corrugated structures having longitudinal corrugations in the range of 120 mm up to 250 mm. With such light gauge material in the suggested range of 16 to 22 gauge, which in millimeters is approximately 1.5 mm in thickness or less, an approach in providing sections of smaller depth which are interconnected in the web region are provided. The smaller depth corrugations facilitate bending of the panels to arch building structure radii without having to form cross-corrugations therein.

Outside of the existing techniques for roll forming and pressing short radius in deep corrugated panels of thick gauge, there does not appear to any other more economical approach. This is particularly the situation considering the general understanding that cold working of the thicker gauge panels to short radius specifications can significantly decrease ductility, embrittle the resulting structure and perhaps even induce the formation of micro-cracks in the outer ridges in the panel.

SUMMARY OF THE INVENTION

The improvements in the structure in accordance with this invention provides short radius panels for soil/metal supporting structures which may be bent to the desired degree without significantly reducing ductility, inducing micro-cracks in the outer ridges of the panels and embrittling the outer ridges.

In accordance with an aspect of the invention, a soil/-metal supporting structure is normally erected by interconnecting cold formed panels. The structure has in cross-section cold formed curved sections of various radii of curvature to provide the structure, wherein:

a) one or more of the curved sections has a short radius of curvature, the short radius of curvature being in the range of 750 mm to 2,500 mm;

b) each of the panels is of thick gauge material having a thickness in the range of 2 mm to 10 mm;

c) each of the panels has deep longitudinally extending cold formed corrugations in the range of 50 mm to 200 mm, the corrugations being sinusoidal in cross-sectional shape and having outside ridges, adjacent interposed inside ridges with webs connecting the inside ridge to adjacent outside ridges, the improvement in the panel structure comprises:

d) the panels have a high degree of ductility before being formed into the curved shape, the high degree of ductility being determined by a ratio of specified yield strength to specify minimum tensile strength being equal to or less than 0.8;

e) the panels of short radius of curvature have cold formed cross-corrugations in each of the inside ridges, the cross-corrugation providing a particular short radius of curvature on a consistent basis for each of the panels of that particular short radius without distorting panel shape to facilitate interconnection with other panels of the structure;

f) the cross-corrugations have a depth in the range of 4 mm to 12 mm and a pitch of 40 mm to 70 mm where the cross-corrugation depth increases and the pitch decreases with increasing panel thickness to a maximum of 12 mm cross-corrugation depth and a minimum pitch of 40 mm;

g) the cross-corrugations have a sinusoidal cross-sectional shape in a direction along the longitudinal length of the panel, the cross-corrugations extending across each of the inner ridges and into the connecting webs; and h) the cold formed panels of short radius with the sinusoidal shaped cross-corrugations has the degree of ductility marginally decreased due to cold forming of the panel such that the ratio is increased to a level equal to or less than 0.8 for plastic analysis and the ratio is increased to a level equal to or less than 0.93 for elastic analysis.

In accordance with another aspect of the invention, a structural panel having the above improvements provided therein is also within the scope of the invention.

In accordance with another aspect of the invention, improvements are provided in a process for cold forming a short radius curvature in a structural panel for use in sold/metal supporting structures. The panel to be worked in accordance with this invention has the characterizing features as recited above. The improvement in the process comprises:

a) selecting the flat sheet to have a ratio of specified minimum yield strength to specified minimum tensile strength equal to or less than 0.8;

b) cold forming cross-corrugations in each of the inside ridges whereby the short radius of curvature is cold formed on a consistent basis for each cold formed panel without distorting cold panel shape to facilitate thereby interconnection with other like panels;

c) the cross-corrugations are formed with a sinusoidal cross-sectional shape in a direction along the longitudinal length of the panel where the cross-corrugations extend across each of the inner ridges and into the connecting webs;

d) the cross-corrugations are formed with a depth in the range of 4 mm to 12 mm and a pitch of 40 mm to 70 mm, where said cross-sectional depth increases and the pitch decreases with increasing panel thickness to a maximum of 10 mm cross-corrugation depth and a minimum pitch of 40 mm.

e) the cold forming of the panel with the cross-corrugations provides the cold formed panels with the ratio increasing marginally to be equal to or less than 0.8 for plastic analysis and equal to or less than 0.93 for elastic analysis.

BRIEF DESCRIPTION OF THE DRAWINGS

Various aspects of the invention are described with respect to the drawings wherein.

DESCRIPTION OF PRIOR ART

Figure 1:
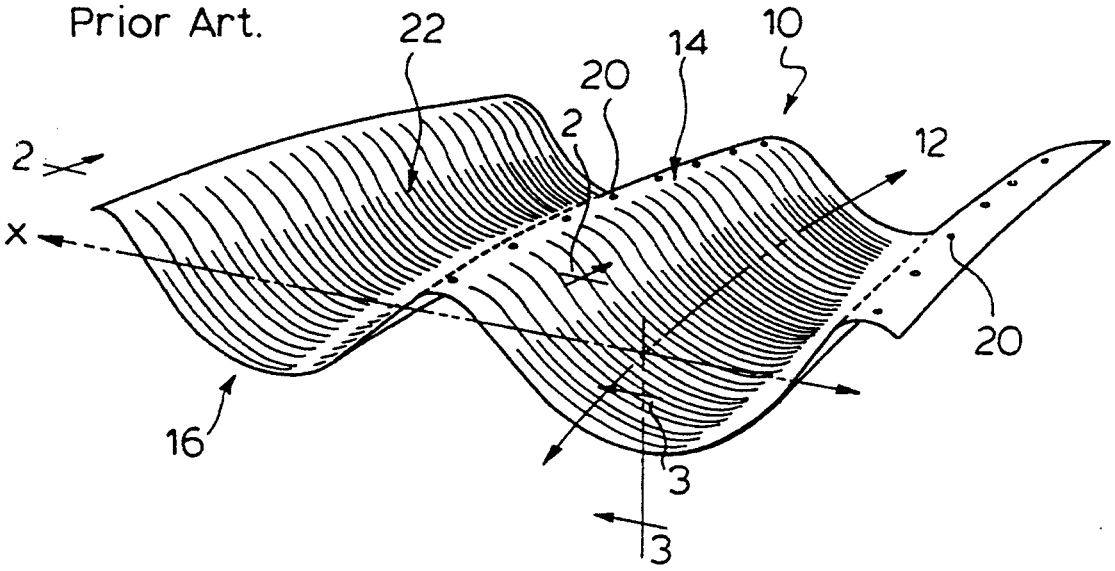
FIG.1. Prior Art.
FIG. 1 is a perspective view of prior art panel having light gauge thickness for use in and building fabrication.
Figure 2:
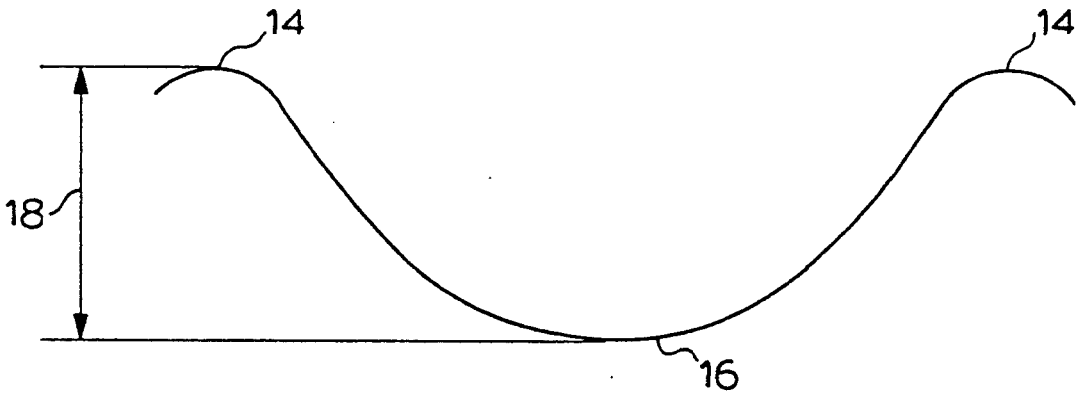
FIG.2. Prior Art.
FIG. 2 is a section along the lines 2—2 of FIG. 1.

FIG. 1 is a perspective view of a panel 10 of light gauge material commonly used in arched type buildings. The panel 10 has the typical longitudinally extending corrugations in the direction of arrow 12 having the ridges 14 and the troughs 16. The panels typically have a depth as shown in FIG. 2, as indicated by arrow 18 in the range of 50 to 200 mm. Although the embodiment shown in FIG. 1 depicts a corrugation which is sinusoidal in section it is understood that such corrugations may also be trapezoidal in section.

The panels 10 have a series of bolt holes 20 provided therein on the ridges 14 to facilitate interconnection of the panels.

Figure 3:
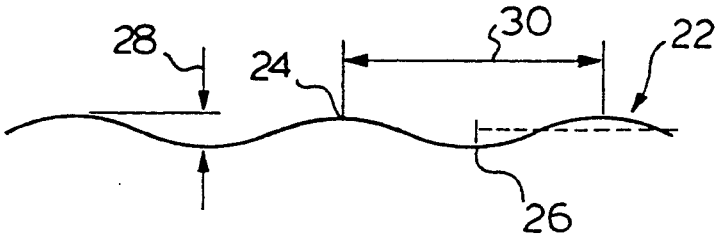
FIG.3. Prior Art.
FIG. 3 is a section along the lines 3—3 of FIG. 1.

As previously mentioned, in order to facilitate bending of the deep corrugation panels on a consistent basis so that the bolt holes 20 become aligned for purposes of structure erection, cross-corrugations generally designated 22 are formed in the troughs 16, that is the inside ridges to shorten the length of the inside ridges so that the panels may be curved. As generally shown in FIG. 1, the radius of curvature for these light gauge panels is quite large, normally in the range of 3,000 mm to 12,000 mm. Typically, however, sinusoidal corrugations may be used to accommodate such bending of the panel. As shown in FIG. 3, the cross-corrugations 22 are sinusoidal in section having ridges 24 and troughs 26. Generally the cross-corrugations have a depth, as indicated by arrow 28, in the range of 1.5 mm to 3 mm with a pitch, as indicated by arrow 30, in the range of 25 to 50 mm. Due to the minimal depth and relatively large pitch of these corrugations, the cold working of the metal is kept to a minimum. Although there have been attempts to move away from such cross-corrugations, generally such approach has been recognized as the acceptable manner in which the panels may be curved for some 20 years or more.

DETAILED DESCRIPTION OF THE PREFERRED EMBODIMENTS

We have discovered that by use of the improvements of this invention, the heavier gauge material used in soil/metal supporting structures can be bent to the specified short radius without significant reduction in ductility, embrittlement or the development of micro-cracks. This has been accomplished by first of all using a panel having longitudinally extending corrugations which are sinusoidal in cross-section, working with panels having a high value for ductility and the use of sinusoidally shaped cross-corrugations which have been surprisingly found in the thicker gauge material to decrease not significantly ductility but permits the formation of the specified short radius of curvature for certain portions of the culvert. These features and advantages of the invention will be described with respect to the box culvert embodiment of this invention although it is appreciated that this invention may be used in any form of short radius panel for use in any type of culvert or the like involving a soil/metal supporting structure.

Figure 4:
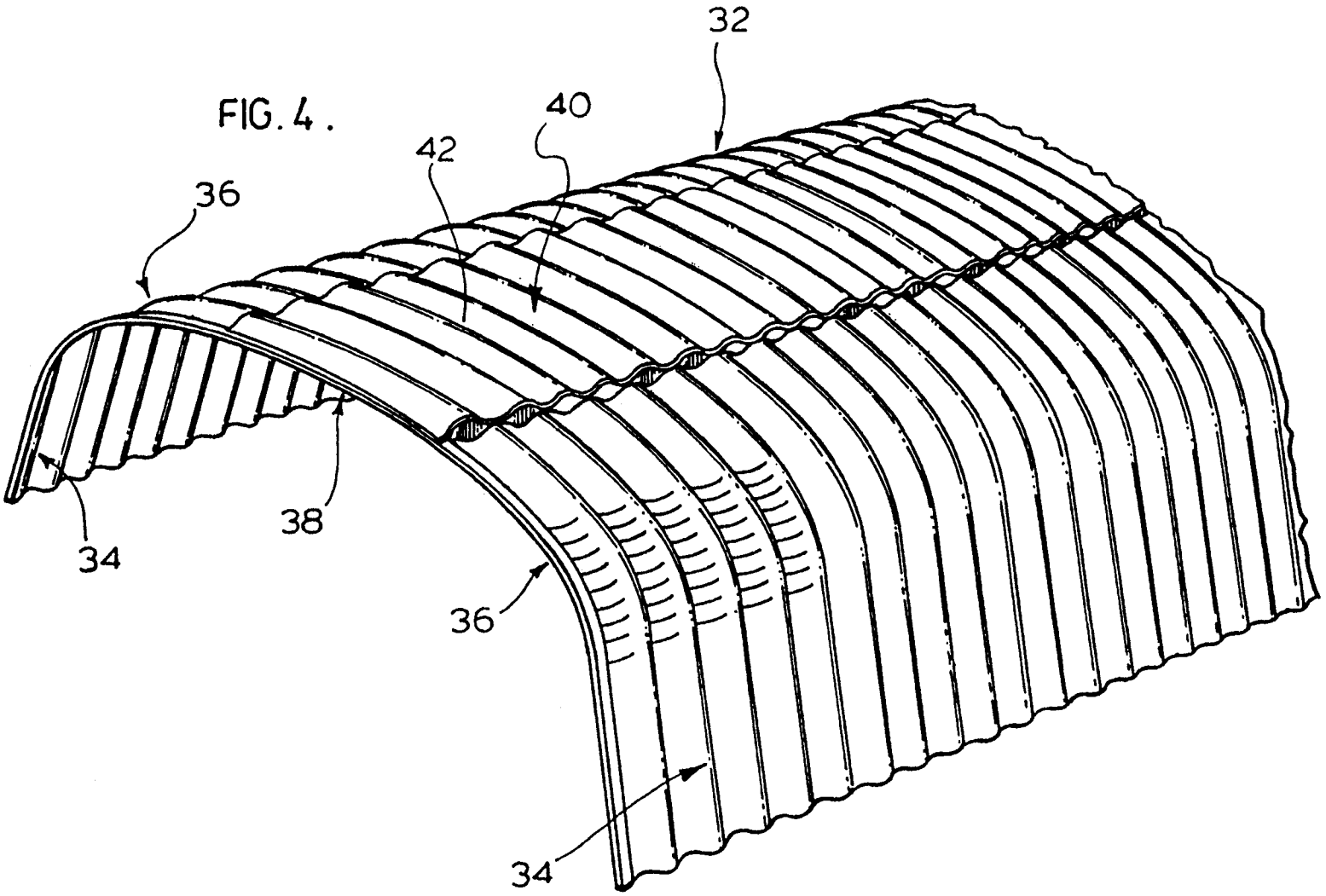
FIG. 4 is a perspective view of a box culvert having short radius curved portions therein.

With reference to FIG. 4, a box culvert 32 has upright sidewalls 34, short radius of curvature haunch portions 36 and a slightly curved crown portion 38. This invention particularly applies to the formation of the short radius haunch portions 36 and in the development of the short radius of curvature with minimal distortion of panel to facilitate field installation. The box culvert of FIG. 4 has the preferred form of continuous reinforcement generally designated 40 which consists of individual panels 42 and are connected not only to themselves but as well to the crown portion 38 of the box culvert. As is described in the aforementioned, applicant's U.S. patent application Ser. No. 08/026,860, this continuous type of reinforcement provides a superior structure in an economical manner which facilitates design for load carrying capacities on a plastic basis, hence, requiring that the short radius portions of the culvert have a high degree of ductility in the range of 0.8 or less. As already mentioned, in order to achieve short radius panel portions with a high degree of ductility, these are either formed with expensive cold forming presses or hot forming presses.

Figure 5:
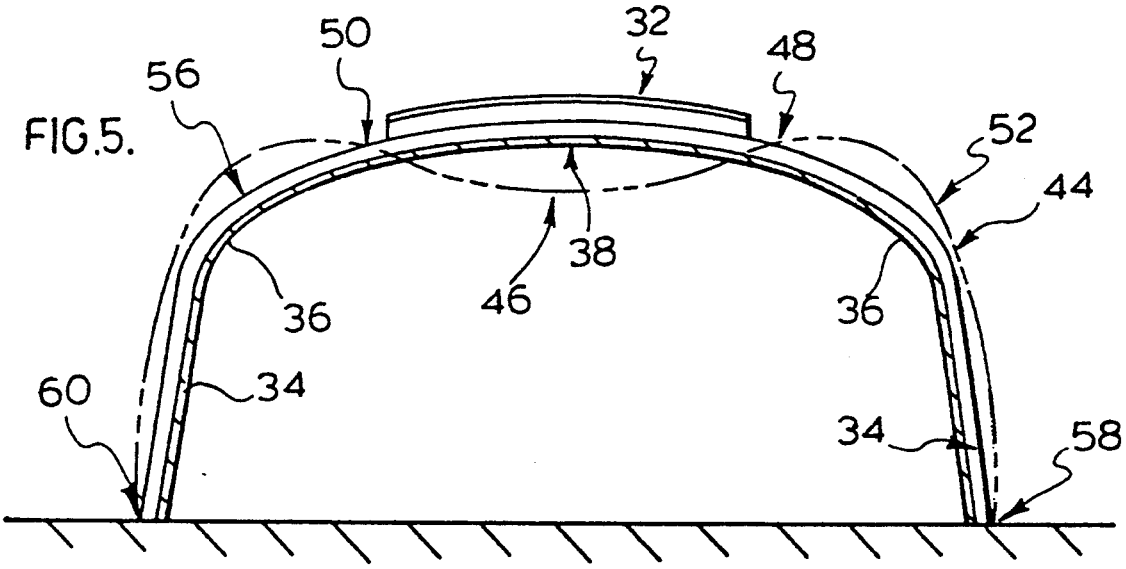
FIG. 5 is an end view of the box culvert of FIG. 4.

The plastic theory of design becomes important in respect of FIG. 5 because the haunch portions tend to flex during such variable loadings to withstand the overall anticipated forces applied to the structure.

As is generally understood by those skilled in the art, the elastic theory of design requires that the design be based on the allowable stress method whereas the plastic theory of design considers the greatest load which can be carried by the structure when acting as a unitary structure. The advantage in a plastic design procedure is that there is a possibility of significant saving in the amount of metal required. The plastic moment is generally understood to be the moment which will produce plasticity in a member of the culvert and created plastic hinge. In the design for example of the metal box culverts of FIG. 5, plastic moments are distributed between the crown 38 and the haunch portions 36. The plastic moment profile under maximum possible load is indicated by line 44 in FIG. 5. The moment reaches a maximum value beneath the crown 38 in the area 46. The moment goes through a zero value where it intersects the crown at positions 48 and 50. The moment then increases through the haunch portions in regions 52 and 56 and reduces to zero at the base of the box culvert in the regions of 58 and 60. By appropriate location of the continuous reinforcement 32, the maximum amount of the plastic moment in excess of 50% may be transferred to the crown 38 within the region between positions 48 and 50 and particularly in the central region 46. Approximately 50% or less of the moment is then distributed to the haunch and sidewall portions in the regions 52 and 56. The ability to design a culvert structure using plastic analysis is of significant benefit. However, it could only be achieved by virtue of expensive forming techniques to form the short radius portions 36 with the desired degree of ductility in the range of 0.8 or less when determined by the ratio of the specified yield strength to specified minimum tensile strength. It is understood however that the benefits of this invention may also be applied to structures which require elastic analysis. This could be due to loads or other extraneous factors which require elastic analysis and hence result in a reduced ductility of the material being equal to or less than 0.93 when measured by this ratio.

Figure 6:
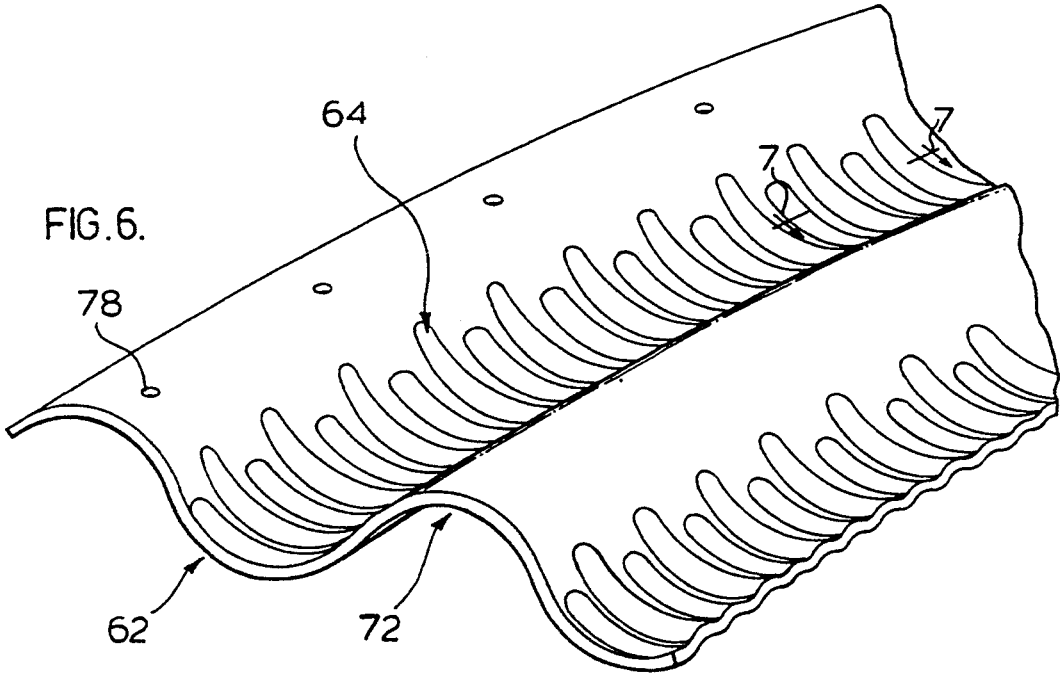
FIG. 6 is a perspective view of a panel having a short radius of curvature for use in the box culvert of FIG. 4.
Figure 7:
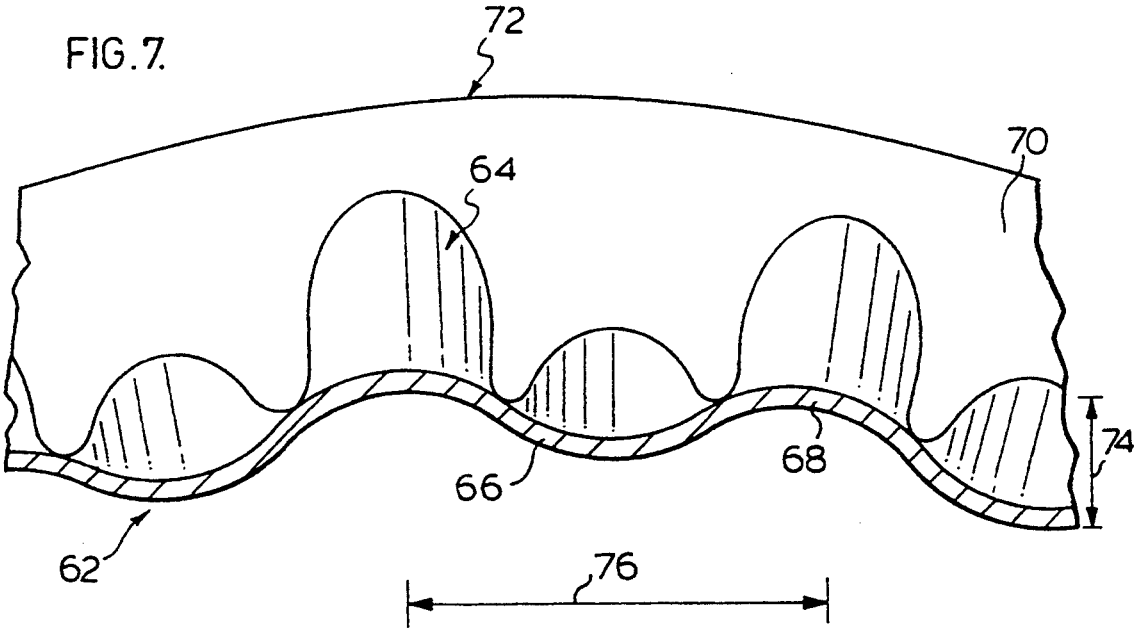
FIG. 7 is a section along the lines 7—7 of FIG. 6.

As shown in FIG. 6, the panels of this invention have a considerably shorter radius of curvature when compared to the radius of curvature of the corrugated panels of FIG. 1 used in arched type buildings. The radius of curvature for the panels of this invention is in the range of 750 mm to 2,500 mm, that is considerably less than the lower range of 3,000 mm and up for arched typed buildings. Furthermore, as demonstrated in respect of FIG. 6, the panels have a considerably greater thickness in the range of 2 mm up to 10 mm. Such thick gauge of material has not been used in arch type buildings because snow loading and wind loading are the only factors in building considerations compared to the loading which is the subject of this invention involving soil/metal support structures. The only real similarity between the panel of FIG. 6 and that the arched type buildings of FIG. 1 is the depth of corrugations where both share deep cold formed corrugations in the range of 50 mm to 200 mm. However, because of all of the problems associated with the cold forming of thick gauge material, one would not attempt to provide any form of cross-corrugations in the thick material because of the difficulties associated with cold working, embrittlement, micro-cracks and dimensional distortion. However, applicant has found by the improvements of this invention that even with the use of cross-corrugations a panel having the specified short radius of curvature can be made on a consistent basis in an inexpensive manner and have dimensional stability to facilitate erection in the field. We have found that by cold forming cross-corrugations in each of the inside ridges 62 of the panel 64 of FIG. 6, the specified short radius of curvature can be achieved on the consistent basis without distorting the panel shape. Such cross-corrugations are formed however in accordance with special requirements in respect of cold forming to avoid embrittlement. The virgin sheets before cold forming to provide both the longitudinal and cross-corrugations, has a high degree of ductility, as determined by the ratio of specified minimum yield strength to specified minimum tensile strength equal to or less than 0.75 to possibly 0.8. Starting with virgin material having a degree of ductility more than this will only result in too high of a ratio so that plastic design cannot be accomplished in the manner described with respect to FIG. 5. The cross-corrugations, generally designated 64 are shown in FIG. 7. They are sinusoidal shaped in cross-section and have trough portions 66 and ridge portions 68 which extend upwardly into the web portions 70 which interconnect an inside ridge 62 to the adjacent outside ridges 72. As shown in FIG. 7, the cross-corrugations 64 extend upwardly into the web portion 70 to approximately ⅔ of the webs height. The cross-corrugations have a depth, as indicated by arrow 74 in the range of 4 mm to 12 mm and a pitch, as indicated by arrow 76, in the range of 40 mm to 70 mm. It is understood that in the use of such cross-corrugations, the depth increases and the pitch decreases with increasing panel thickness and as well increasing radius of curvature to the maximum of 12 mm cross-corrugation depth and a minimum pitch of 40 mm. It is understood of course that these dimensional requirements may vary slightly depending upon the choice of material and particularly in distinguishing between a steel structure or an aluminum structure. In certain situations where aluminum is preferred, it is understood that the selected material has greater workability, although a much lower of degree of ductility. By virtue of such workability a much thicker material may be selected to achieve similar short radius of curvature.

It has been surprisingly found that by use of such sinusoidal shaped cross-corrugations, in combination with the sinusoidally shaped longitudinal corrugations, that such specified short radius of curvature can be achieve with marginal decrease in ductility due to the cold working of the panel. Such marginal decrease in ductility normally results in a ratio which is equal to or less than the beginning 0.8 for plastic analysis and in other circumstances where warranted the ductility ratio is at a level equal to or less than 0.93 for elastic analysis. In any event, it was generally understood that the cross-corrugations in thick material would unnecessarily increase the hardness of the material to an extent that ductility would not be retained for plastic analysis let alone elastic analysis.

Accordingly, with this invention, it is preferred that the ratio for the virgin flat sheet material prior to any cold forming is less than 0.75 particularly for panels of steel rather than aluminum. The depth of corrugations which extend longitudinally of the short radius panel are preferably in the range of 100 mm to 175 mm with the common range being 130 mm to 160 mm.

With steel panels the thickness is usually in the range of 3 mm to 7 mm where the panel has a short radius of curvature preferably in the range of 1,000 mm to 2,000 mm. It is understood however in box culvert design the range may be 1,050 mm to 1,500 mm.

Furthermore, by use of the above design criteria it has been found that reinforced metal box culverts which are normally subject to vibratory, cyclical and repeated loads and which can induce fatigue failure is avoided with the structure of this invention because of the lack of embrittlement and micro-cracks in the outside skin of the outside ridges of the corrugated structure. This is further facilitated by the use of plastic analysis in the design of the box culvert where the width and thickness ratios of the cold formed shapes are capable of developing plastic hinges in the aforementioned regions of FIG. 5 without local buckling.

The process in fabricating such panels of specified short radius of curvature is then altered to include the steps of providing the cross-corrugations during the bending operation. Normally, panels of this thick gauge of material have the longitudinally extended corrugations roll form therein and then subsequently the panels are bent to the specified radius of curvature. In accordance with this invention, the process in forming the curvature may be the standard bumping process where the panel is slowly cold worked into the desired radius of curvature by a sequential stepwise bumping process. By forming the cross-corrugations in the inside ridges of the structure while bumping the material to curve it, it has been found that there is little if any reduction in the ductility. The cross-corrugations may be formed in accordance standard techniques involving offset press portions which form the corrugations as the panel is bumped to take on the desired radius of curvature. Such cross-corrugations are formed in the material or within the specified limits, as discussed with respect to FIG. 7 while achieving the very sharp radius of curvature compared to the panels of FIG. 1. It is important to note that the cross-corrugations are sinusoidal in cross-sectional shape to avoid any sharp edges in the deformation of the material to further reduce the possibility of a formation of micro-cracks or embrittlement in the surfaces of the worked material. The bolt holes are normally formed in the panel before it is bent to the desired radius of curvature. Commonly the circumferented bolt holes are formed in the ridge portion 72 as shown in FIG. 6 and designated 78. The bolt holes of one sheet are overlapped with an adjacent sheet and bolted together at the two adjacent spaced apart ridges 72 to complete a secure interconnection. The significant benefit in the process and resulting panel of this invention is that the panels are formed on a consistent basis with the correct curvature so that the bolt holes align and thereby facilitate assembly and erection of the structure in the field.

EXAMPLES

Example 1

Virgin flat material was cold worked in accordance with the process of this invention to reveal surprising results with respect to the ductility as measured by Fy/Fu. As is understood by those skilled in the art, Fu is a measure of the specified minimum tensile strength and Fy is a measure of the specified minimum yield strength, both being the units of ksi. The specified radius of curvature for the panel when curved was 1,016 mm. The results of the tests are shown in the following Table 1 where the ductility of the flat virgin material based on the ratio of Fy/Fu was 71.5. This measure of ductility in terms of the ratio was increased to 78.2 by virtue of cold forming longitudinally extending corrugations in the flat virgin material referenced in Table 1 as Corrugated-Side. The next step in the process is to form the desired radius of curvature in the longitudinally corrugated material. This is referenced in Table 1 as Corrugated-Haunch, the radius of curvature being 1,016 mm. The loss in ductility is indicated by the increase in the ratio to 83.8 which is slightly above the desired 0.8 value for plastic design but is suitable to allow analysis of the structure based on elastic design. This test was carried out on material having a thickness 6.76 mm.

TABLE 1

| Material (Steel) | Radius mm | Fu KSI | Fy KSI | Fy/Fu |
|---|---|---|---|---|
| Flat Virgin | 0 | 59.2 | 41.6 | 0.715 |
| Corrugated-Side | 0 | 60.2 | 47.1 | 0.782 |
| Corrugated-Haunch | 1016 | 68.0 | 57.0 | 0.838 |

Although preferred embodiments of the invention have been described herein in detail, it will be understood by those skilled in the art that variations may be made thereto without departing from the spirit of the invention or the scope of the appended claims.

We claim:

1. In a soil/metal supporting structure formed by interconnecting cold formed panels to provide said structure, said structure having in cross-section cold formed curved sections of various radii of curvature to provide said structure:

a) one or more of said curved sections having a short radius of curvature, said short radius of curvature being in the range of 750 mm to 2500 mm;

b) each of said panels being of thick gauge material and having a thickness in the range of 2 mm to 10 mm;

c) each of said panels having deep longitudinally extending cold formed corrugations of a depth in the range of 50 mm to 200 mm, said corrugations being sinusoidal in cross-sectional shape and having outside ridges adjacent interposed inside ridges with webs connecting said inside ridge to adjacent outside ridges, the improvement comprising:

d) said panels having a high degree of ductility before being cold formed into said curved shape, said high degree of ductility being determined by a ratio of specified minimum yield strength to specified minimum tensile strength being equal to or less than 0.8;

e) said panels of short radius of curvature having cold formed cross-corrugations in each of said inside ridges, said cross-corrugations providing a particular said short radius of curvature on a consistent basis for each said panel of that particular short radius without distorting panel shape to facilitate interconnection with other panels of said structure;

f) said cross-corrugations having a depth in the range of 4 mm to 12 mm and a pitch of 40 mm to 70 mm where said cross-corrugation depth increases and said pitch decreases with increasing panel thickness to a maximum of 12 mm cross-corrugation depth and a minimum pitch of 40 mm;

g) said cross-corrugations having a sinusoidal cross-sectional shape in a direction along the longitudinal length of said panel, said cross-corrugations extending across each of said inner ridges and into said connecting webs;

h) said cold formed panels of short radius with said sinusoidal shaped cross-corrugations having said degree of ductility marginally decreased due to cold forming of said panel, such that said ratio is increased to a level equal to or less than 0.8 for plastic analysis and said ratio is increased to a level equal to or less than 0.93 for elastic analysis.

2. In a soil/metal supporting structure of claim 1, said ratio for virgin flat sheet material prior to any cold forming being less than 0.75.

3. In a soil/metal supporting structure of claim 2, said panels being of steel or aluminum.

4. In a soil/metal supporting structure of claim 1, said depth of corrugations extending longitudinally of said short radius panel being in the range of 100 mm to 175 mm.

5. In a soil/metal supporting structure of claim 4, said depth of said longitudinal corrugations being in the range of 130 mm to 160 mm.

6. In a soil/metal supporting structure of claim 1, said panel having a thickness in the range of 3 mm to 7 mm.

7. In a soil/metal supporting structure of claim 1, said panel having a short radius of curvature in the range of 1000 mm to 2000 mm.

8. In a soil/metal supporting structure of claim 7, said radius of curvature being in the range of 1050 mm to 1500 mm.

9. In a soil/metal supporting structure of claim 1, said structure being a box culvert.

10. In a soil/metal supporting structure of claim 1, said structure being an elliptical, round, pear, arch or pipe-arch shaped culvert.

11. In a structural panel for use in a soil/steel supporting structure:

a) said panel having a short radius of curvature in the range of 750 mm to 2500 mm along the longitudinal length of said panel;

b) each of said panels being of thick gauge material and having a thickness in the range of 2 mm to 10 mm;

c) each of said panels having deep longitudinally extending cold formed corrugations of a depth in the range of 50 mm to 200 mm, said corrugations being sinusoidal in cross-sectional shape and having outside ridges adjacent interposed inside ridges with webs connecting said inside ridge to adjacent outside ridges, the improvement comprising:

d) said panel having a high degree of ductility before being cold formed into said curved shape, said high degree of ductility being determined by a ratio of specified minimum yield strength to specified minimum tensile strength being equal to less than 0.8;

e) said panel having cold formed cross-corrugations in each of said inside ridges, said cross-corrugations providing a particular said short radius of curvature on a consistent basis for said panel without distorting panel shape to facilitate interconnection with similar panels for the soil/metal supporting structure;

f) said cross-corrugations having a depth in the range of 4 mm to 12 mm and a pitch of 40 mm to 100 mm where said cross-corrugation depth increases and said pitch decreases with increasing panel thickness to a maximum of 12 mm cross-corrugation depth and a minimum pitch of 40 mm;

g) said cross-corrugations having a sinusoidal cross-sectional shape in a direction along the longitudinal length of said panel, said cross-corrugations extending across each of said inner ridges and into said connecting webs;

h) said cold formed panels having said degree of ductility marginally decreased due to cold forming of said panel, such that said ratio is increased to a level equal to or less than 0.8 for plastic analysis and said ratio is increased to a level equal to or less than 0.93 for elastic analysis.

12. In a soil/metal supporting structure of claim 11, said ratio for virgin flat sheet material prior to any cold forming being less than 0.75.

13. In a soil/metal supporting structure of claim 12, said panel being of steel or aluminum.

14. In a soil/metal supporting structure of claim 11, said depth of corrugations extending longitudinally of said short radius panel being in the range of 100 mm to 175 mm.

15. In a soil/metal supporting structure of claim 14, said depth of said longitudinal corrugations being in the range of 130 mm to 160 mm.

16. In a soil/metal supporting structure of claim 11, said panel having a thickness in the range of 3 mm to 7 mm.

17. In a soil/metal supporting structure of claim 11, said panel having a short radius of curvature in the range of 1000 mm to 2000 mm.

18. In a soil/metal supporting structure of claim 17, said radius of curvature being in the range of 1050 mm to 1500 mm.

19. In a structural panel of claim 11, said panel being for use in a short radius haunch portion of a box culvert.

20. In a structural panel of claim 11, said panel being for use in a short radius portion of an clliptical, round, pear, arch or pipe-arch shaped culvert.

21. In a process for cold forming a short radius curvature in a structural panel for use in a soil/metal supporting structure, said panel being characterized by:

a) a short radius of curvature in the range of 750 mm to 2500 mm;

b) a thick gauge material having a thickness in the range of 2 mm to 10 mm;

c) deep longitudinally extending cold formed corrugations of a depth in the range of 50 mm to 200 mm, said corrugations being sinusoidal in cross-sectional shape and having outside ridges, adjacent interposed inside ridges with webs connecting said inside ridge to adjacent outside ridges;

the process including the steps of:

d) selecting flat sheet to be cold formed into said panel;

e) cold forming said deep longitudinal corrugations into said flat sheet to provide a substantially straight section of corrugated panel;

f) cold forming an arch in said straight section of panel to provide said panel having a short radius of curvature;

the improvement in said process comprising;

g) in said step d, selecting said flat sheet to have a ratio of specified minimum yield strength to specified minimum tensile strength equal to or less than 0.8;

h) cold forming cross-corrugations in each of said inside ridges whereby said short radius of curvature is cold formed on a consistent basis for each cold formed panel without distorting curved panel shape to facilitate interconnection with other like panels;

i) said cross-corrugations being formed with a sinusoidal cross-sectional shape in a direction along the longitudinal length of said panel where said cross-corrugations extend across each of said inner ridges and into said connecting webs;

j) said cross-corrugations being formed with a depth in the range of 4 mm to 12 mm and a pitch of 40 mm to 70 mm where said cross-sectional depth increases and said pitch decreases with increasing panel thickness to a maximum of 12 mm cross-corrugation depth and a minimum pitch of 40 mm;

k) said cold forming of said panel with said cross-corrugations providing said cold formed panel with said ratio increasing marginally to be equal to or less than 0.8 for plastic analysis and equal to or less than 0.93 for elastic analysis.

22. In the process of claim 21, said flat sheet is selected with said ratio being less than 0.75.

23. In the process of claim 22, said flat sheet is steel or aluminum.

24. In the process of claim 21, said longitudinal corrugations being cold formed in the range of 100 mm to 175 mm.

25. In the process of claim 21, said flat sheet is selected with a thickness in the range of 3 mm to 7 mm.

26. In the process of claim 21, said step of cold forming said short radius of curvature in the range of 1000 mm to 2000 mm.

27. In the process of claim 21, said cross-corrugations as cold formed in said webs, extending up each web by about ⅔ of the web width.

* * * * *